United States Patent [19]

Ferrazza et al.

[11] Patent Number: 4,655,394

[45] Date of Patent: Apr. 7, 1987

[54] DUAL PURPOSE FOAM GENERATING AND HIGH PRESSURE NOZZLE

[75] Inventors: Gerald P. Ferrazza, Schaumburg; Pamela R. Huck, Villa Park, both of Ill.

[73] Assignee: Spraying Systems Co., Wheaton, Ill.

[21] Appl. No.: 683,648

[22] Filed: Dec. 19, 1984

[51] Int. Cl.[4] ..... B05B 7/00

[52] U.S. Cl. ..... 239/412; 239/428.5

[58] Field of Search ..... 239/310, 311, 427, 427.3, 239/428.5, 451, 452, 453, 456, 459, 410, 412, 106, 112, 113, 533.1, 570

[56] References Cited

U.S. PATENT DOCUMENTS

| | | | |
|---|---|---|---|
| 1,726,490 | 8/1929 | Irving et al. | 239/456 X |
| 2,820,673 | 1/1958 | Zubaty | 239/453 |
| 3,202,363 | 8/1965 | Kautz et al. | 239/570 X |
| 3,246,660 | 4/1966 | Hammelmann | 239/453 X |
| 3,893,624 | 7/1975 | Thompson | 239/453 X |
| 3,961,754 | 6/1976 | Kuhns et al. | 239/428.5 X |
| 4,071,195 | 1/1978 | Kuhns et al. | 239/311 X |
| 4,330,086 | 5/1982 | Nysted | 239/428.5 X |

FOREIGN PATENT DOCUMENTS

| | | | |
|---|---|---|---|
| 870429 | 6/1961 | United Kingdom | 239/533.1 |

*Primary Examiner*—Joseph F. Peters, Jr.
*Assistant Examiner*—Mary Beth O. Jones
*Attorney, Agent, or Firm*—Leydig, Voit & Mayer

[57] ABSTRACT

A dual purpose nozzle for low pressure foam generating and high pressure fluid spraying including a nozzle body having inlet and outlet portions and defining a slide chamber and a mixing chamber, an inner nozzle is slidably mounted in the slide chamber and having an internal passageway for communicating fluid from the inlet portion to the outlet portion of the nozzle body, the mixing chamber terminating in an outlet discharge opening and the nozzle body having at least one inlet opening therein upstream of the outlet discharge opening for admitting air into the mixing chamber, the inner nozzle having a discharge end with a primary discharge opening therein generally aligned with the outlet discharge opening in the nozzle body, a spring is provided for biasing the inner nozzle in an upstream direction with the discharge end normally disposed above the air opening in the mixing chamber so that low pressure fluid entering the mixing chamber from the passageway draws air in through the air openings to generate a foam of bubbles and droplets which is sprayed from the outlet discharge opening of the nozzle body. Shoulders are provided on the inner nozzle for causing it to move downstream in the slide chamber and the mixing chamber against the bias of the spring when high pressure fluid is admitted to the passageway and discharged from the end thereof below the air intake openings and in close proximity to the discharge end of the nozzle body to form a high pressure fluid spray.

6 Claims, 6 Drawing Figures

DUAL PURPOSE FOAM GENERATING AND HIGH PRESSURE NOZZLE

FIELD OF THE INVENTION

The present invention relates generally to spray nozzles and more particularly concerns a dual purpose low pressure foaming and high pressure rinsing spray nozzle.

BACKGROUND OF THE INVENTION

Fluid spray nozzles are used for many purposes to dispense various fluids such as water, paint, chemical insecticides, pesticides and various emulsions and foams on a variety of applied media. One example of spray nozzle utilization is for cleaning dirty or soiled equipment, a specific example of which is a coin-operated car wash. Typically such a car wash provides a source of liquid cleaning agent, e.g. a chemical detergent mixed with water, and an apparatus for applying the cleaning agent. This may be a fluid supplied brush which is used to create a cleaning foam, but more recently foam generating nozzles have been developed for spraying the cleaning agent directly on the parts to be cleaned. Generally these foaming nozzles operate at relatively low pressure on the order of about 30–45 psi to prevent excessive splashing and wasteful usage of the cleaning agent. Two examples of such foaming spray nozzles are illustrated in U.S. Pat. No. 3,784,111 assigned to the same assignee as the present application.

Once the foamed cleaning agent is applied and allowed to work for a brief period of time, it is then rinsed from the apparatus being cleaned. Rinsing is usually done with plain tap water and is sprayed at relatively high pressure, e.g. on the order of 500 psi or more to literally scrub the surface clean and carry the loosened dirt away. It will be appreciated that most spray cleaning operations require separate foaming nozzles and low pressure sources of cleaning agents and separate high pressure rinse nozzles which literally doubles the equipment requirements for such installations. In other instances, a separate compressed air source is provided for use with the spray nozzle which is then operated at low pressure so that the air is injected to generate a foam of the cleaning solution. However, this too requires a relatively expensive air supply arrangement and atomizing nozzle adaptation.

Accordingly, it is the primary aim of the present invention to provide a dual purpose foam generating and high pressure rinse nozzle. A more specific object is to provide such a nozzle which automatically operates to efficiently produce a well mixed dense foam when supplied with a low pressure foaming solution and which is also capable of automatically discharging a high pressure jet spray in a selected spray pattern when supplied with a high pressure fluid such as rinse water.

Another object of the invention is to provide a dual purpose nozzle of the above type which is relatively simple and economical to manufacture and easy to operate, clean and service, when necessary. It is likewise an object to provide such a nozzle which is durable and thus gives long lasting and trouble free service.

SUMMARY OF THE INVENTION

The dual purpose nozzle of the present invention employs a nozzle body having inlet and outlet portions defining an internal slide chamber and a mixing chamber with an inner nozzle slidably mounted therein and normally biased to an upstream position by a suitable compression spring. The inner nozzle member has a stepped internal passageway for communicating fluid from the inlet portion to the mixing chamber of the nozzle body which has at least one air inducing opening therein. The discharge end of the inner nozzle is normally located upstream of the air entrance openings so as to draw air therethrough for mixing and generating a foam of bubbles and droplets which is sprayed from the outlet discharge opening of the nozzle body, and shoulder means are provided within the stepped internal passageway for causing the inner nozzle to move downstream in the slide chamber and mixing chamber against the bias of the spring when high pressure fluid is admitted to the passageway and discharged from the end thereof below the air intake openings and in close proximity to the discharage end of the nozzle body to form a high pressure fluid spray.

In the preferred embodiment, the inner nozzle is formed with a radially extending flange intermediate the ends thereof, the spring normally biases the flange against an upstream portion of the nozzle body, and the flange engages a downstream shoulder of the slide chamber when high pressure fluid in the stepped internal passageway moves the inner nozzle against the bias of the spring. The inner nozzle and the outlet nozzle body are preferably formed with transverse discharge slots at their respective ends and the slide chamber and the inner nozzle are complementarily formed to maintain the slots in registry with one another in order to form a fan-like spray pattern.

BRIEF DESCRIPTION OF THE DRAWINGS

Other objects and advantages suggested above will become more readily apparent upon reading the following detailed description and upon reference to the drawings, in which.

Figure 1:
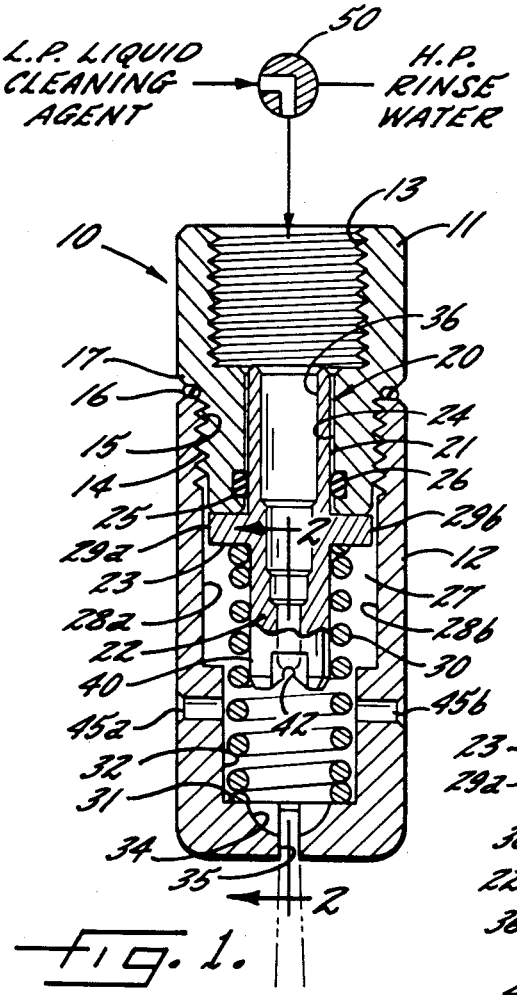
FIG. 1 is a vertical section taken through the dual purpose spray nozzle of the present invention.
Figure 2:
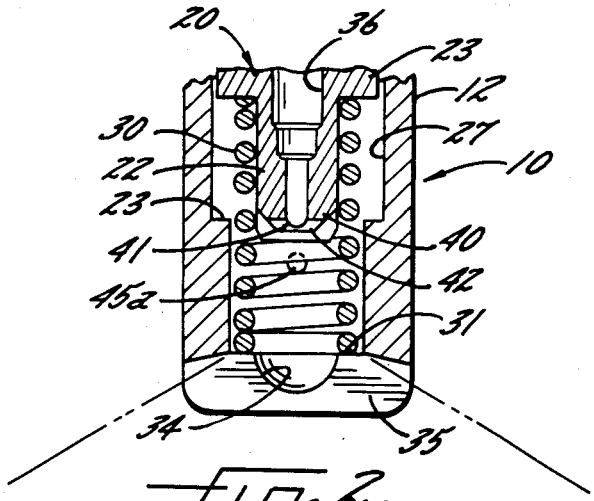
FIG. 2 is a fragmentary section taken substantially along line 2—2 in FIG. 1.
Figure 3:
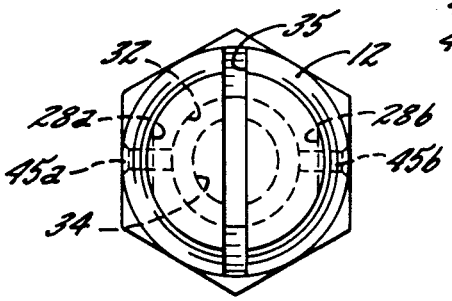
FIG. 3 is an end view of the outlet end of the spray nozzle of FIG. 1.

While the invention is susceptible of various modifications and alternative constructions, a preferred embodiment has been shown in the drawings and will be described below in detail. It should be understood, however, that there is no intention to limit the invention to the specific form illustrated and described but, on the contrary, the intention is to cover all modifications, alternative constructions and equivalents falling within the scope of the invention.

DESCRIPTION OF THE PREFERRED EMBODIMENT

Turning now to the drawings, there is shown in FIG. 1 an improved dual purpose low pressure foaming and high pressure rinsing nozzle 10 of the present invention. The nozzle 10 includes a fluid inlet body 11 and a spray outlet body 12. In the illustrated embodiment, the inlet body 11 is internally threaded at one end 13 to receive an externally threaded member or coupling element of a pressurized fluid supply source such as a hand held spray gun or the like (not shown). The other end of the fluid inlet body 11 is preferably formed with external threads 14 which may be screwed into the internally threaded end portion 15 of the spray outlet body 12. To seal the threaded connection between the inlet body 11 and outlet body 12, an O-ring or similar gasket-like element 16 may be compressed between the annular end of the outlet body 12 and a peripheral shoulder 17 formed on the inlet body 11 adjacent the threaded portion 14.

For communicating fluid from the inlet body 11 to the outlet body 12, a slidable internal nozzle element 20 is provided. As shown in FIG. 1, the internal nozzle 20 is formed with a generally cylindrical external shape having an upper sleeve portion 21 and a lower sleeve portion 22 joined together by an integrally formed radially projecting flange 23. The upper sleeve portion 21 is received in a centrally located axially extending bore 24 formed in the inlet body 11 downstream of the internally threaded portion 13. Preferably, the bore 24 is formed with an annular groove 25 for receiving an O-ring seal 26 which slidably and sealingly surrounds the upper sleeve portion 21 of the inner nozzle 20.

To receive the internal nozzle 20, the outlet body 12 is formed with an internal slide chamber 27 which in the illustrated embodiment is generally cylindrical in shape with a pair of diametrically opposed flat guide surfaces 28*a*, 28*b*. Likewise, the flange 23 on the inner nozzle 20 is generally cylindrical with a pair of diametrically opposed flats 29*a*, 29*b* which face and engage the guide surfaces 28*a*, 28*b* in the outlet body 12. It will be understood, of course, that the flange 23 and internal slide chamber 27 may be formed with other complementally shaped cross sections such as, for example, modified square or hexagonal configurations in order to insure that the inner nozzle is inserted and maintained in proper registry with the spray outlet body 12.

Figure 4:
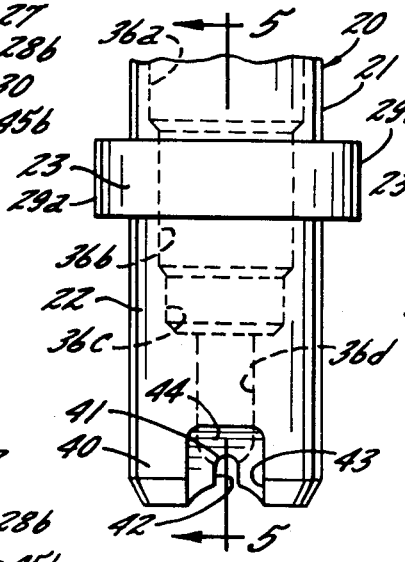
FIG. 4 is an enlarged fragmentary side elevation of the slidable inner nozzle member of the spray nozzle of FIG. 1.
Figure 5:
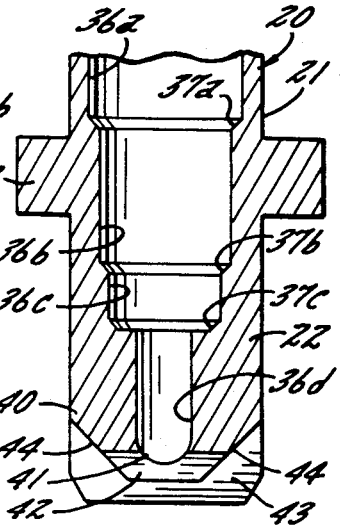
FIG. 5 is a fragmentary section taken substantially along line 5—5 in FIG. 4; and, FIG. 6 is an end view of the outlet end of the slidable inner nozzle member shown in FIG. 4.
Figure 6:
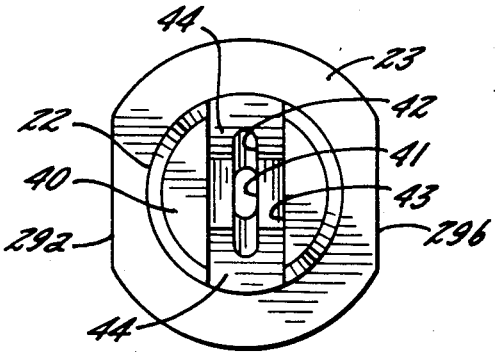

Fluid flow through the nozzle 10 is by means of an internal passageway 36 formed in the inner nozzle body 20. As shown in more detail in FIGS. 4 and 5, the passageway 36 of the illustrated inner nozzle is of stepped down design and is formed with increasingly smaller diameter sections 36–*d* separated by internal annular shoulders 37*a*–*c*, respectively. The discharge end 40 of the inner nozzle is formed with a generally oval-shaped orifice 41 leading out from the lower internal passageway 36*d* and exiting into primary and secondary transverse slots 42 and 43 which are aligned generally parallel to the major axis of the orifice 41. Preferably, the ends of the slots 42 and 43 are relieved at 44 to further promote the fan-like spread of the sprayed fluid.

To operate as a foaming spray nozzle, fluid such as water mixed with a suitable chemical or cleaning agent is introduced at relatively low pressure e.g., 30–45 psi into the inlet body 11 from a suitable source (not shown). The fluid passes through the stepped passageway 36 of the inner nozzle 20 and exits through the orifice 41 and transverse slots 42, 43 in an expanding fan-like spray. As the fluid passes through the mixing chamber 32 in the outlet body 12 a pressure drop is created and air is drawn into the mixing chamber 32 through a pair of induction openings 45*a* and 45*b* formed in the outlet body 12. The fluid and air are mixed in the mixing chamber 32 and form a dense foam of bubbles and suspended fluid droplets which is discharged in a fan like spray pattern from the transverse slot 35 in the discharge end of the outlet body.

As previously mentioned, this low pressure foam generating nozzle is particularly well suited for spraying a cleaning foam on grimy equipment such as automobile wheels and tires, for example. It is desired that such foam cleaner be applied at relatively low pressure so that it does not splash off the applied surface but, instead, literally clings to the soiled surface until it is rinsed off. This period may be on the order of one half minute or less or can be considerably longer depending upon the strength of the cleaning agent, the nature of the dirt being removed and the sensitivity of the underlying surface to the applied chemical.

When it is desired to utilize the nozzle 10 for fluid rinsing, it is only necessary to admit a high pressure rinsing fluid such as warm water to the inlet body 11 of the nozzle 10. This may be done, for example, by simply turning a manual valve such as schematically shown at 50 or actuating a remote solenoid operated valve (not shown) from a source of low pressure cleaning agent to a source of high pressure rinse water which may be pressurized at 500 psi or more, although pressure as low as about 100 psi could be used. The high pressure rinse water exerts pressure on the internal shoulders 37*a*–*c* of the stepped internal passageway 36 and moves the internal nozzle 20, like a hydraulic piston, downward against the bias of the spring 30 until the lower face of the flange 23 abuts the internal shoulder 33 at the end of the slide chamber 27. The internal passage 36 may be of constant diameter, if desired, and it will be understood, of course, that the piston effect of the internal nozzle is provided by the differential cross sectional area between the nozzle body 20 and the orifice 41.

Under such high pressure spraying conditions, the discharge end 40 of the inner nozzle 20 is disposed substantially in the hemispherical recess 34 of the nozzle outlet body 10. It will also be understood that the primary and secondary transverse slots 42, 43 of the internal nozzle are aligned with the transverse discharge slot 35 in the end of the outlet body 12. Thus the high pressure fluid is sprayed out through the orifice 41 and slots 42, 43 and 35 in a generally fan-shaped pattern.

When the inner nozzle 20 is forced downward by the high pressure fluid the lower sleeve 22 passes the air induction openings 45*a* and *b* in the mixing chamber 32 and air is no longer drawn in and mixed with the fluid and thus little or no foam is generated. Conversely, when the source of high pressure fluid is turned off the compression spring 30 returns the inner nozzle 20 upward in the slide chamber 27 so that the upper face of the flange 23 abuts the annular end of the inlet body member 11 and if low pressure cleaning agent is admitted, a cleaning foam is generated.

From the foregoing, it will be seen that a simple and efficient dual purpose foaming and rinsing nozzle is provided. Under low fluid pressure, water and a cleaning agent may be admitted to the nozzle 10 and air is drawn into the mixing chamber 32 to generate a dense foam that is sprayed out of the transverse discharge slot 35 in a fan-like pattern. It will be understood that other spray patterns may be formed, if desired, by appropriately changing the shape of the respective discharge openings. Under high fluid pressure, warm rinse water may be admitted to the nozzle 10 causing the inner nozzle 20 to shift downward cutting off the air supply and directing the fluid spray out successively through the transverse slots 42, 43 and 35 in a fan-like fluid pattern. Thus one spray nozzle 10 may be used to alternately spray a low pressure cleaning foam and a high pressure rinsing solution by merely turning a valve or otherwise opening 50 to the appropriate fluid source. Due to its simple design the nozzle 10 is relatively inexpensive to manufacture and easy to operate, clean and service.

We claim as our invention:

1. A dual purpose nozzle for low pressure foam generating and high pressure fluid spraying comprising, in combination, a nozzle body having inlet and outlet portions, means defining a slide chamber and a mixing chamber in said nozzle body, an inner nozzle slidably mounted in said slide chamber and having an internal passageway for communicating fluid from said inlet portion to said outlet portion of said nozzle body, said mixing chamber terminating in an outlet discharge opening and said body having at least one inlet opening therein upstream of said outlet discharge opening for admitting air into said mixing chamber, said inner nozzle having a discharge end with a primary discharge opening therein generally aligned with said outlet discharge opening in said nozzle body, means for biasing said inner nozzle in an upstream direction with said discharge end normally disposed in said mixing chamber such that low pressure fluid entering said mixing chamber from said passageway draws air in through said at least one inlet opening to generate a foam of bubbles and droplets which is sprayed from said outlet discharge opening of said nozzle body, and shoulder means on said inner nozzle for automatically causing said inner nozzle to move downstream in said slide chamber and said mixing chamber against the force of said biasing means when high pressure fluid is admitted to said passageway such that the primary discharge opening of said inner nozzle is moved into close proximity to said outlet discharge opening of said nozzle body and fluid is discharged from said outlet discharge opening in the form a high pressure fluid spray and the flow of air through said at least one inlet opening is substantially blocked.

2. The nozzle defined in claim 1 wherein said inner nozzle is formed with a radially extending flange intermediate the ends thereof, said biasing means normally biases said flange against an upstream portion of said nozzle body, and said flange engages a downstream shoulder of said slide chamber when high pressure fluid moves said inner nozzle against the bias of said spring.

3. The nozzle defined in claim 1 wherein said inner nozzle and said outlet of said nozzle body are formed with transverse discharge slots at their respective ends and said slide chamber and said inner nozzle are complementarily formed to maintain said slots in registry with one another.

4. The nozzle defined in claim 1 wherein said passageway in said inner nozzle is formed with progressively stepped down portions separated from one another by annular shoulders.

5. The nozzle defined in claim 1 wherein said inner nozzle member is formed with an upper sleeve portion and said inlet portion of said nozzle body is formed with an internal axial bore for slidably receiving said upper sleeve portion and sealing means are provided between said bore and upper sleeve portion of said inner nozzle member.

6. A dual purpose nozzle for low pressure foam generating and high pressure fluid spraying comprising, in combination, a nozzle body having inlet and outlet portions, means defining a slide chamber and a mixing chamber in said nozzle body, an inner nozzle slidably mounted in said slide chamber and having an internal passageway for communicating fluid from said inlet portion to said outlet portion of said nozzle body, said mixing chamber terminating in an outlet discharge opening and said body having at least one inlet opening therein upstream of said outlet discharge opening for admitting air into said mixing chamber, said inner nozzle having a discharge end with a primary discharge opening therein generally aligned with said outlet discharge opening in said nozzle body, means for biasing said inner nozzle in an upstream direction with said discharge end normally disposed in said mixing chamber such that low pressure fluid entering said mixing chamber from said passageway draws air in through said at least one inlet opening to generate a foam of bubbles and droplets which is sprayed from said outlet discharge opening of said nozzle body, and said inner nozzle being automatically moveable in a downstream direction in said slide chamber against the force of said biasing means in response to the introduction of high pressure fluid in said passageway so that the primary discharge opening of said inner nozzle is located in close proximity to said outlet discharge opening in said nozzle body and fluid is discharged from said outlet discharge opening in the form of a high pressure fluid spray and the flow of air through said at least one inlet opening is substantially blocked.

* * * * *